United States Patent [19]

Rudolph et al.

[11] Patent Number: 4,624,298

[45] Date of Patent: Nov. 25, 1986

[54] METHOD OF COOLING STRANDS IN THE CONTINUOUS CASTING OF STEEL

[75] Inventors: Günter W. Rudolph, Jork; Karl Stercken, Rosengarten; Eckehard F. O. Forster, Seevetal, all of Fed. Rep. of Germany

[73] Assignee: Hamburger Stahlwerke GmbH, Hamburg, Fed. Rep. of Germany

[21] Appl. No.: 746,950

[22] PCT Filed: Dec. 11, 1981

[86] PCT No.: PCT/EP81/00191

§ 371 Date: Aug. 17, 1982

§ 102(e) Date: Aug. 17, 1982

[87] PCT Pub. No.: WO82/02160

PCT Pub. Date: Jul. 8, 1982

Related U.S. Application Data

[63] Continuation of Ser. No. 413,366, Aug. 17, 1982, abandoned.

[30] Foreign Application Priority Data

Dec. 23, 1980 [DE] Fed. Rep. of Germany ..... 3048711

[51] Int. Cl.[4] ..... B22D 11/124

[52] U.S. Cl. ..... 164/486; 164/455

[56] References Cited

U.S. PATENT DOCUMENTS 3,771,584 11/1973 Wojcik ..... 164/455

FOREIGN PATENT DOCUMENTS 53-26730 3/1978 Japan ..... 164/486

*Primary Examiner*—Kuang Y. Lin

[57] ABSTRACT

Method of cooling strands in the continuous casting of steel with a carbon content of 0.05 to 1.1 weight-percent, in which, for the production of billets having reduced segregations, cooling is performed very intensively in a first stage (3) and less intensively in a second stage (4) (FIG. 4).

10 Claims, 4 Drawing Figures

Steel with 0,76 % C, 0,22 % Si, 0,50 % Mn, 0,016 % P and 0,017 % S)

Steel with 0,56 % C, 0,22 % Si, 0,57 % Mn, 0,013 % P and 0,020 % S)

Steel with 0,66 % C, 0,22 % Si, 0,63% Mn, 0 016 % P and 0,012 % S )

METHOD OF COOLING STRANDS IN THE CONTINUOUS CASTING OF STEEL

This application is a continuation, of application Ser. No. 413,366, filed Aug. 17, 1982, now abandoned.

The invention concerns a method of cooling strands in the continuous casting of steel.

In a number of steel products, such as high-carbon steel wires, their technological properties are perceptibly impaired by segregations. In the patenting of such wires from the rolling temperature, such segregations can result in the formation, at the point of segregation, of brittle phases, often referred to as "martensite", which greatly diminish the ductility of the wire.

While in the casting of ingots, the segregations are found in the upper third of the ingot and can be removed by cutting off the top, in continuous casting they become distributed over the entire length of the strand and cannot be removed by cutting. Their negative effects are greater in so-called "small-size" strand casting—dimensions from 100 to 140 mm on a side—is greater than in large-size strand casting, i.e., pre-billet sizes of 200 to 300 mm on a side, since the small sizes require less reduction in rolling to the final product. Considerable efforts have already been devoted by people skilled in the art to reduce the segregations in continuous casting or diminish their negative effects on the rolled product. In the course of such developments, the impression has developed that a so-called globulitic structure is associated with low segregation, but a dendritic structure is associated with heavy segregation. By the term, "globulitic structure," as used herein, a structure is to be understood in which the crystals do not have a preferred direction of growth, but are distributed randomly over the cross section. FIG. 1 shows the structure of a continuous-cast billet having a large proportion of such a globulitic structure. By a dendritic structure, on the other hand, a structure is meant in which the predominant direction of growth of the crystals runs into the metal, perpendicular to the strand surface.

On account of the impression that dendritic structure would promote segregations and reduce globulitic structure, the efforts of the art field have concentrated on increasing the proportion of the globulitic structure. A variety of approaches have been taken for this purpose.

One approach is to stir the molten steel in the solidifying strand to prevent the formation of a dendritic structure and thus reduce segregations (see, for example, DE-C-No. 17 83 060). The stirring action is generally brought about by electromagnetic stirring apparatus. In any case, complex apparatus are necessary.

Another approach to achieving globulitic structure is based on keeping the casting temperature very low. In this case, difficulties are caused by the fact that the casting nozzles tend to clog up.

Extensive studies with the aim of reducing segregations by casting at low temperatures or by electromagnetic stirring in steels of 0.3 to 1.0% carbon yielded the finding that a slight reduction of segregations is achievable, but that this reduction is not sufficient to achieve a marked improvement of the technical properties of such steels in the production of rolled wire. In fact, in the application of electromagnetic stirring a more frequent occurrence of "martensite" was observed.

In a continuous steel casting process for steels having a carbon content of 0.05 to 1.1% by weight, especially those having a carbon content of 0.3 to 1.0% by weight, it is the object of the invention to produce billets of reduced segregations, from which rolled wire, preferably, can be produced having improved mechanical and technological properties. In particular, an improvement is to be achieved in small-size continuous casting, i.e., in the case of dimensions up to 140 mm on a side. Also, when the wire rolled from a billet is heat-treated, the development of "martensite" at segregations is to be prevented.

It has been found that, contrary to prevalent opinion, particularly in the case of a steel with a carbon content of 0.3 to 1%, the segregations can be considerably reduced if the steel is cooled very intensively within the stated limits. This effect is also to be observed at high casting temperatures and casting rates. The amount of the reduction of the segregations is sufficient to improve substantially the technological properties of rolled wire made from a continuous-cast billet thus obtained. Also the occurrence of "martensite" at segregation points after controlled cooling of the rolled wire from the rolling heat is decidedly reduced.

In the case of very intensive cooling, there is the danger that cracks may occur on the surface or in the interior of the billet. This problem is important not only in steels with a carbon content of 0.3 to 1% by weight, but also in steels of lower carbon content whenever the casting rate and the intensity of the cooling are increased to increase productivity. This problem is solved by the present invention.

In the case of a two-stage cooling, no cracking whatsoever occurs on the surface of the billet or in the interior of the billet. On the billet surface a very fine-grained layer is formed which reduces the liability of the billet to form cracks during rolling. The microetching, represented in FIG. 3, of a quartered slice from a billet shows this fine-grained layer, which in the case of strong cooling amounts on the average to about 4 to 10 mm on the lateral surfaces of the billet and as much as 25 mm at the edges thereof.

The invention will be further explained in conjunction with four figures, of which FIG. 1 is a sulfur print of the longitudinal section through the central axis of a billet having a large percentage of globulitic structure;

Figure 4:
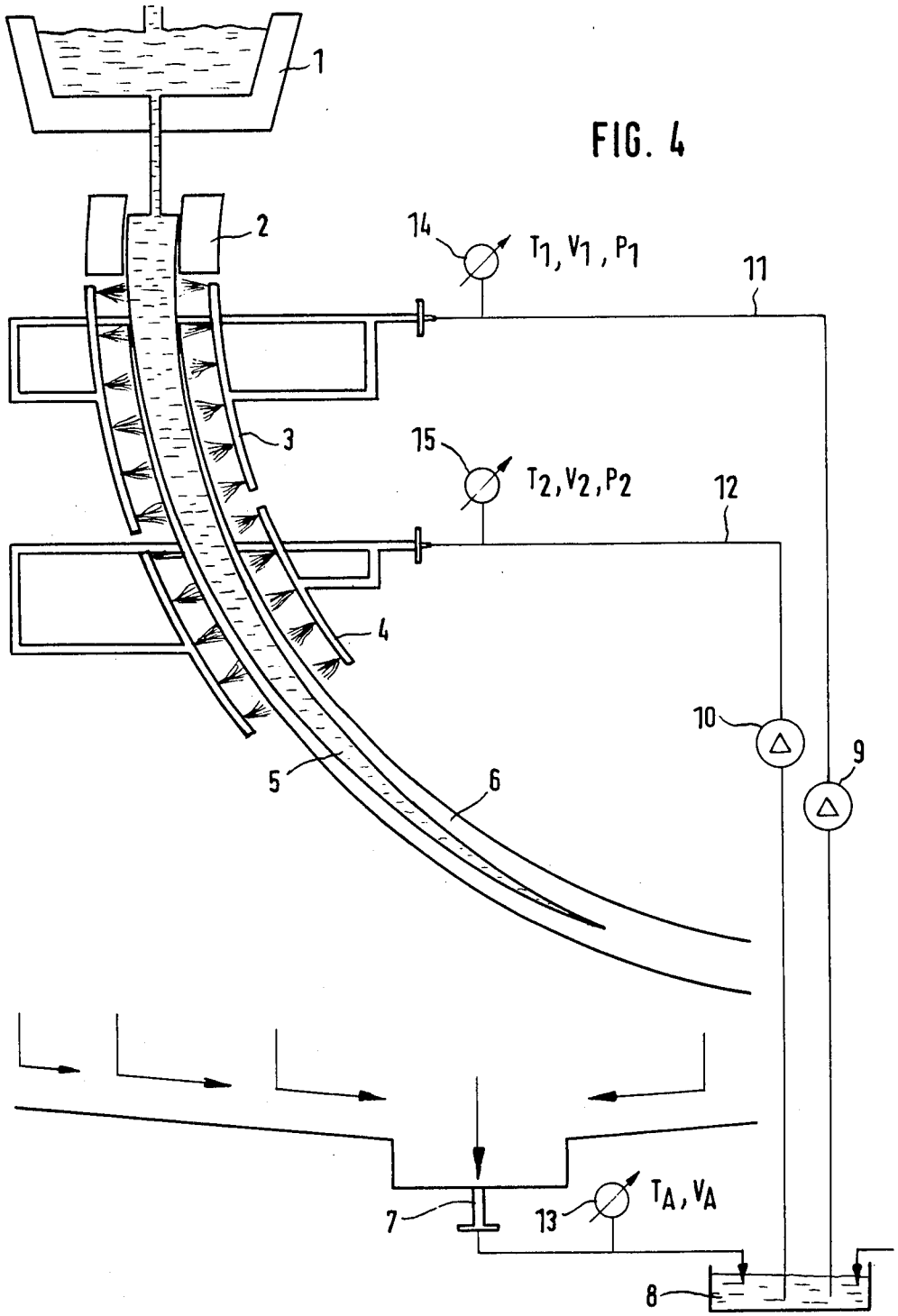
FIG. 4 is a diagrammatic representation of an apparatus for performing the process.

FIG. 4 is a diagrammatic representation of a continuous steel casting apparatus for performing the process of the invention. Molten steel is poured from a distributing trough 1 into an oscillating, cooled continuous casting mold 2 in which the outer skin solidifies during the slow downward movement of the metal strand. The mold is followed by two cooling stages 3 and 4 in which the strand is sprayed uniformly with water over its entire periphery. The molten heart of the metal strand is marked 5, the solidified shell of the strand being marked 6. All of the downwardly draining spray water is collected in a collector pipe 7 and delivered to a water reservoir 8. The cooling stages 3 and 4 are supplied with spray water from the water reservoir 8 through pipe lines 11 and 12. To the spray water collecting line 7 there is connected an apparatus 13 to determine the temperature $T_A$ and the rate of flow $V_A$ of the drain water, and apparatus 14 and 15 are associated with stages 1 and 2 to detect the water temperature, the water rate of flow and the water pressure, $T_1$, $V_1$, $P_1$ and $T_2$, $V_2$, $P_2$, respectively, at the entrance to the stages in question. Also present are controlling and regulating means, not shown, for the purpose of being able to vary these magnitudes. The division of the water between the two stages is determined by measuring, in the one case, the rate of flow $V_A$ and the temperature $T_A$ of the drain water when both stages 1 and 2 are in operation, and in the other when only stage 1 is in operation.

In the conventional method of production of continuous cast steel in the 0.3 to 1.0% carbon range, in the case, for example, of a square cross section measuring 120 mm on a side, and a pouring rate of 2.4 meters per minute, the strand is sprayed below the mold with water at a water forepressure of commonly 3 bar, but a maximum of 8 bar, at a rate of water flow of about 20 to 30 cubic meters per hour per strand.

In the process according to the invention, the cooling is intensified by elevating the thermal transfer coefficient by intensified cooling with water at the surface of the billet. This results in a reduction of segregations.

A very intensive cooling leads, of course, to the danger of cracking at the surface of the strand. These cracks are prevented by the fact that the very intense cooling of the billet of the size specified, and at the casting rate stated of 2.4 meters per minute, is limited to a length of about 2 meters below the mold, i.e., to a time of stay of the strand of approximately 40 to 60 seconds. A strand surface temperature of about 650° C. to 950° C. then establishes itself. In this range—referred to hereafter as stage 1—approximately 50 Wh/kg to 90 Wh/kg (Watt hours per kilogram) are removed from the strand, corresponding to a cooling rate of approximately 65 Wh/(kg.min) to 100 Wh/(kg.min) (Watt hours per kilogram per minute). After this very intense cooling, the strand is cooled with reduced intensity for a time of stay of approximately 30 to 50 sec (in the case of the stated size). The amount of heat removed in this range—referred to hereafter as stage 2—under the stated conditions, for a continuous casting apparatus in which the strand is guided around a curve, is about 20 Wh/kg to 40 Wh/kg, corresponding to a cooling rate of 30 Wh/(kg.min) to 60 Wh(kg.min). In a continuous casting apparatus with the strand guided straight, the values for the removed amount of heat are 20 Wh/kg to 80 Wh/kg, that is, slightly higher.

The amount of heat withdrawn (Wh) can be determined on the basis of the amount of water sprayed on and its temperature increase from inlet to drain, i.e., $V_1 \cdot C_w \cdot (T_1 - T_A)$ for stage 1 and $V_2 \cdot C_w \cdot (T_2 - T_A)$ for stage 2, $C_w$ representing the specific heat of the water [1.163 Wh/(°C.kg of water)]. To this amount of heat there is to be added an amount which is removed by the vaporization of cooling water. The computation is based on the fact that 3.5% of the water sprayed on is vaporized, 93 Wh/kg of water being required to heat the water that is vaporized from 20° C. to 100° C., and the heat of vaporization amounts to 627 Wh per kg of water. In addition to the removal of heat by forced convection produced by the spray cooling, additional amounts of heat are removed from the strand by radiation, free convection and thermal conduction, at guide rollers, for example. The last two amounts of heat are negligible in a continuous ingot casting installation.

The amount of heat removed by radiation depends on the strand surface temperature and therefore diminishes relatively and absolutely as the intensity of the spray cooling increases. In the intense cooling in accordance with the invention, it amounts to approximately 6%, and in the second stage approximately 10%, of the total amount of heat removed, while in the case of conventional cooling it amounts to around 15 to 35% of the total heat removed.

Preferably the spray cooling is performed in a closed chamber. In this case, the percentage of the heat removed by radiation is ultimately removed through the cooling water and is thus contained in the values determined from the amount of water and the water temperature elevation. In this case, therefore, no more than the amount of heat withdrawn by the vaporization of the cooling water, which as a rule ranges between 3.0 and 4.0% of the amount of water that is sprayed on, needs to be added to the heat removed by the cooling water.

If a change is made to other casting rates or to other strand sizes, the cooling must be adapted to them in such a manner that the rate of cooling in Wh/(kg.min) and the amounts of heat removed in the two cooling stages remain approximately constant.

If no bending of the strand takes place, then stage 2 can be lengthened and thus the amount of heat withdrawn in this stage can be increased.

The large amounts of heat withdrawn in the first stage are achieved by increasing the pressure and/or the rate of flow of the cooling water with respect to the conventional procedure. A cooling water forepressure $P_1$ of 15 to 30 bar appears to be economically advantageous.

Figure 1:
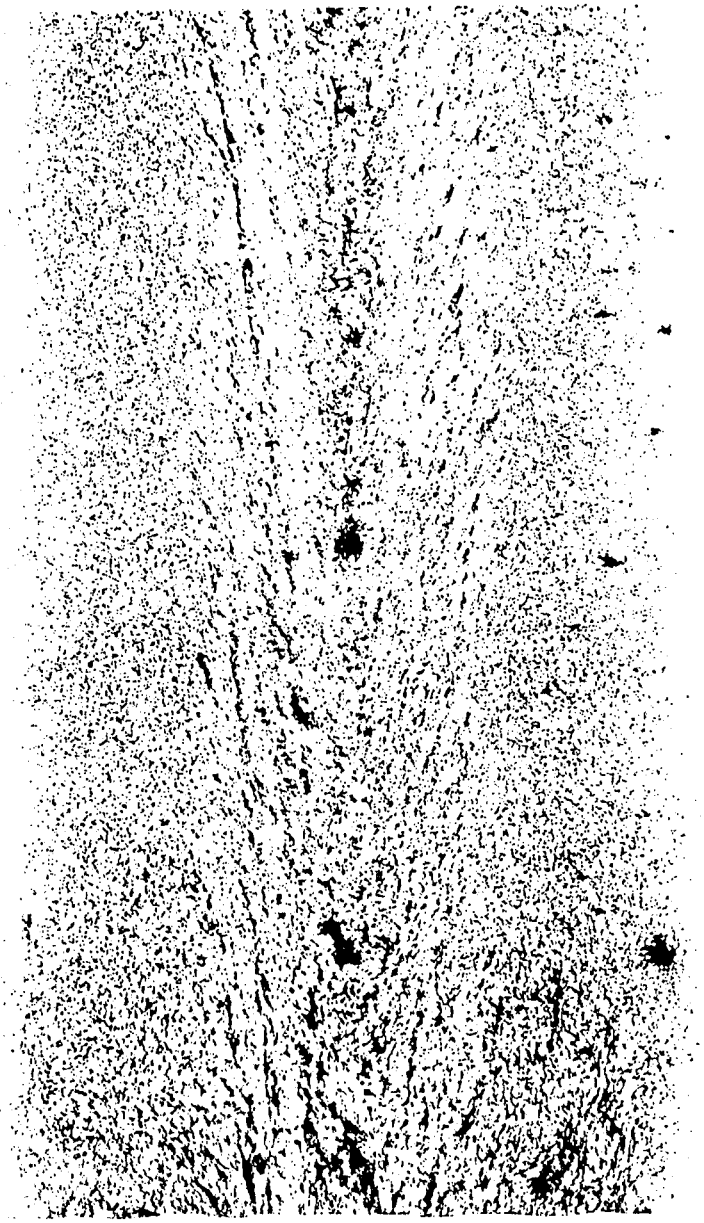
Figure 2:
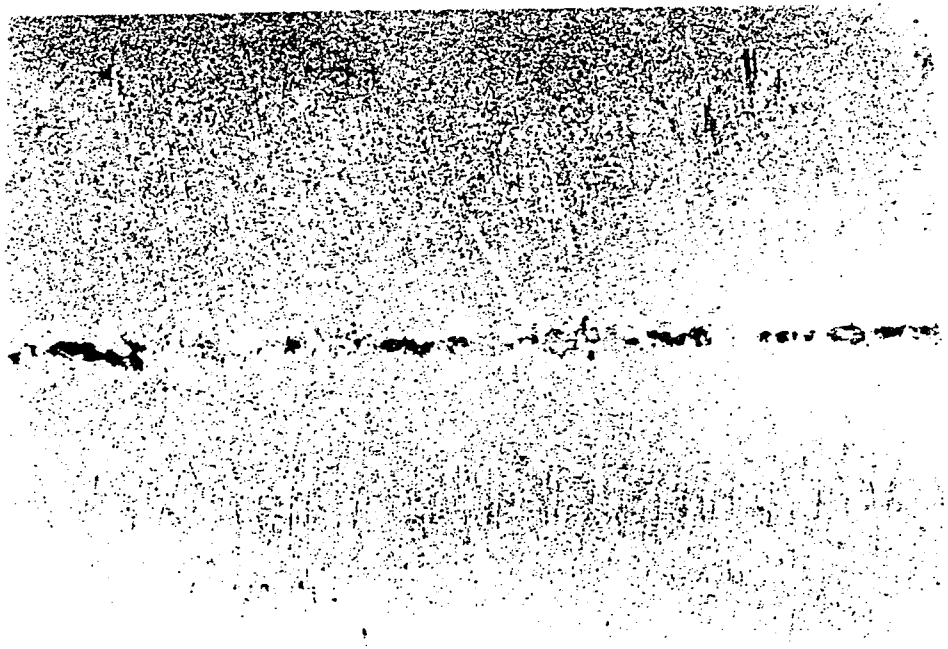
FIG. 2 is a sulfur print of the longitudinal section through the central axis of a billet having a large percentage of dendritic structure.

The structure of the continuous-cast strand material produced in this manner has a high proportion of dendritic structure, approximately corresponding to FIG. 2.

Figure 3:
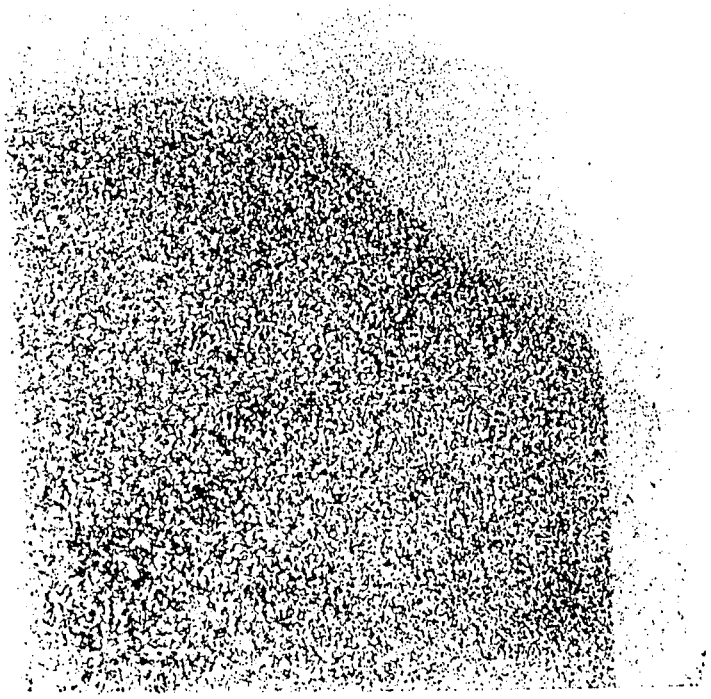
FIG. 3 is a microetching of a quartered slice cut from a billet of intensively cooled material having a fine-grained globulitic marginal zone.

The marginal zone of the billets produced in this manner has, as shown in FIG. 3, an extraordinarily fine-grained "globulitic" structure. The thickness of the marginal zone amounts to at least 4 mm as compared with the 1 mm commonly found. The billets are thus made substantially more resistant to the development of cracks at high stresses in the rolling operation, since the dendritic structure, which is sensitive to separation at the grain boundary, does not come so close to the surface.

If billets produced in this manner with a carbon content of 0.3 to 1% are rolled to produced rolled wire, it is found that the segregations are substantially reduced in comparison to the known method of procedure described in the beginning. In wires having these carbon contents, the segregations in the rolled wire are commonly judged according to an index number of the Bekaert firm. The average guide number in 5.5 mm wire in the aforesaid carbon range can be reduced by the procedure described from approximately 1.1 to 0.6. In the quench from the rolling heat, if the steel has the conventional manganese content of up to 0.9%, and it is quenched at the conventional rate of up to 15° C. per second, no "martensite" is any longer found at the remaining segregation points in the wire produced in this manner.

The technical advance lies in the fact that in this manner a rolled wire of low segregation content can be produced from small-size continuous-cast steel, which can be formed at high drawing speeds, and which achieves high values in the so-called bending test and in the so-called torsion test, i.e., has good plastic and elastic qualities. This rolled wire can be quenched from the rolling heat at high quenching rates without the formation of the brittle phase called "martensite" at the segregation points.

The material furthermore has less tendency under the high stresses of the rolling operation to form cracks on the surface than normal continuous-cast material, on account of the thickened globulitic marginal zone.

EXAMPLE OF EMBODIMENT

A steel containing 0.65% C, 0.27% Si, 0.68% Mn, 0.012% P, 0.013% S, 0.05% Cu, 0.02% Cr and 0.01% Mo was cast by the continuous casting process. The casting temperature in the distributing trough 1 of the continuous casting apparatus was 1530° C. and was thus 50° C. above the liquidus point. The steel was cast in a continuous casting apparatus with an arcuate guidance of the strand to form square strands measuring 120 mm on a side. One strand from this apparatus was cooled in a secondary cooling zone having two stages 3 and 4. The casting rate was 2.5 meters per minute. The first stage 3 of intensified cooling extended from the mold 2 over a length in the casting direction of the strand of 1.9 m, corresponding to a time of stay of the strand of 46 seconds. Here the strand was cooled, at a forepressure $P_1$ ahead of the spray nozzles of 22 bar, with a water flow rate of 31 $m^3/h$. This established at the surface of the strand a thermal transfer coefficient (by convection and radiation) of 1500 $W/(m^2.K)$ to 1700 $W/(m^2.K.)$ This corresponds to a cooling rate of 91 Wh/(kg.min) and to a withdrawn amount of heat of 70 Wh/kg. The proportion of the amount of heat withdrawn by radiation amounts in this case, as calculated with a degree of emission of $\epsilon=0.8$, to 3.9 Wh/kg, i.e., 5.6%. This was followed by a second stage 4 of reduced water cooling of a length of 1.6 m, corresponding to a time of stay of 38 seconds. Here the forepressure $P_2$ ahead of the nozzle was around 7 bar, and the rate of flow of the water was around 12 $m^3/h$. The thermal transfer coefficient here amounted to 800 $W/(m^2.K)$ to 900 $W/(m^2.K)$, the cooling rate to 47 Wh/(kg.min) and the withdrawn amount of heat, 30 Wh/kg, with a radiation portion of 2.8 Wh/kg, i.e., 9.4%.

For comparison, the parallel strands were cooled in a first stage in the conventional manner with a water pressure of 3 bar and a rate of flow of 14 $m^3/min$ per strand. This flow of water was also applied in a secondary cooling zone, again for a stay of 46 seconds. This corresponds to a cooling rate of 50 Wh/(kg.min) or a removed amount of heat of 38 Wh/kg, with a radiation loss of 9.7 Wh/kg, or 25.5%. The thermal transfer coefficient amounted to about 500 $W/(m^2.K)$ to 700 $W/(m^2.K)$.

The material was rolled in a two-strand wire rolling mill to form 5.5 mm rolled wire. A micrographic examination of the rolled wire and testing by the Bekaert method of rating resulted in an average rating of 0.6 for the material intensively cooled in accordance with the invention, and of 1.4 for the material cooled in the conventional manner. While the wire made from intensively cooled billets was free of "martensite", "martensite" was found in 12% of the wires made from normally cooled billets. The material prepared in accordance with the invention had a tensile strength of 1050 $N/mm^2$ and was drawn in a wire-drawing plant in a 6-stage drawing machine to a diameter of 2.3 mm. Thereafter it had a tensile strength of 1743 $N/mm^2$ and could be bent 23 times on a radius of 7.5 mm, while the conventional material could withstand only 17 bends. Then the material was cold-rolled to a thickness of 1.7 mm in one pass without annealing. In the intensively cooled material there were no rejects, while the normally cooled material after cold rolling to 1.7 mm no longer possessed satisfactory technological properties. The quality difference is also expressed by the fact that the equidimensional elongation of the band of the material made in accordance with the invention amounted to 2.9%, while in the material used for comparison it was only 1.8%.

The segregation data and mechanical values of the wires produced from these heats are directly comparable, both for the intensively cooled material and for the material used for comparison, to the values described above.

The process of the invention is especially applicable to a steel containing:

- 0.4 to 1 weight-percent carbon,
- 0.2 to 1.7, preferably 0.3 to 0.9, weight-percent manganese,
- 0.1 to 0.7, preferably 0.15 to 0.4, weight-percent silicon,
- 0 to 1.7, preferably 0 to 0.25, weight-percent chromium,
- 0 to 0.5, preferably 0 to 0.3, weight-percent nickel,
- 0 to 0.3, preferably 0 to 0.04, weight-percent sulfur, and as a balance, iron and common impurities.

The process is also particularly applicable to strands having a round, oval, rectangular or square cross section of 2,500 to 20,000 $mm^2$, with the axis ratio in an oval cross section and the ratio of the sides in a rectangular cross section, amount to a maximum of 2:1.

We claim:

1. A method of continuous casting of a strand of steel with a carbon content of 0.4 to 1 percent by weight, comprising the steps of spraying on the strand emerging from a strand casting mold a cooling liquid in a secondary cooling zone in a first step intensively and in a second step at a reduced cooling rate, the temperatures, rates of flow and pressures of the cooling liquid being adjusted so as to remove an amount of heat of 50 Wh/kg to 90 Wh/kg from a first stage in the secondary cooling zone, the cooling being performed at a cooling rate of 65 Wh/(kg.min) to 100 WH/(kg.min), and so as to remove in an adjoining second stage an amount of heat of 20 Wh/kg to 80 Wh/kg at a cooling rate of 30 Wh/(kg.min) to 60 Wh/(kg.min).

2. A method according to claim 1, wherein, in the first stage of the secondary cooling zone, an amount of heat of 50 Wh/kg to 80 Wh/kg is removed.

3. A method according to claim 1, wherein, in the first stage, the cooling rate is 75 Wh/(kg.min) to 90 Wh/(kg.min).

4. A method according to claim 1, wherein, in the second stage of the secondary cooling zone, an amount of heat of 30 Wh/kg to 60 Wh/kg is removed.

5. A method according to claim 1, wherein, in the second stage, the cooling rate amounts to 35 Wh/(kg.min) to 45 Wh/(kg.min).

6. A method according to claim 1, wherein the pressure of the cooling liquid ahead of spray nozzles of the first stage amounts to at least 15 bar.

7. A method according to claim 1, wherein the strand is a steel billet.

8. A method according to claim 1, wherein the strand has a round, oval, rectangular or square cross section of 2,500 to 20,000 $mm^2$, the axis ratio in an oval cross section and the ratio of the sides in a rectangular cross section, amounting to a maximum of 2:1.

9. A method according to claim 1, wherein the steel contains:

0.4 to 1 weight-percent carbon,
0.2 to 1.7 weight-percent manganese,
0.1 to 0.7 weight-percent silicon,
0 to 1.7 weight-percent chromium,
0 to 0.5 weight-percent nickel,
0 to 0.3 weight-percent sulfur, and as a balance, iron and common impurities.

10. A method according to claim 9, wherein the steel contains:

0.4 to 1 weight-percent carbon,
0.3 to 0.9 weight-percent manganese,
0.15 to 0.4 weight-percent silicon,
0 to 0.25 weight-percent chromium,
0 to 0.30 weight-percent nickel,
0 to 0.04 weight-percent sulfur, and as a balance, iron and common impurities.

* * * * *